United States Patent [19]

Bogdanski

[11] 4,164,724

[45] Aug. 14, 1979

[54] BIMETALLIC THERMO-RELEASE, ESPECIALLY FOR PROTECTIVE MOTOR SWITCH

[75] Inventor: Franz Bogdanski, Springe, Fed. Rep. of Germany

[73] Assignee: Sprecher & Schuh AG, Switzerland

[21] Appl. No.: 902,543

[22] Filed: May 2, 1978

[51] Int. Cl.[2] ..... H01H 61/00

[52] U.S. Cl. ..... 337/86; 337/87; 337/95

[58] Field of Search ..... 337/70, 71, 77, 78, 337/86, 87, 95, 102, 112, 38, 47

[56] References Cited

U.S. PATENT DOCUMENTS 3,792,401 2/1974 Anderson ..... 337/95 X 3,800,260 3/1974 Woodger ..... 337/78 X

*Primary Examiner*—George Harris

*Attorney, Agent, or Firm*—Haseltine, Lake & Waters

[57] ABSTRACT

A bimetallic thermo-release, especially for protective motor switches, comprising at least one bimetallic release element connected with connections for the connection of electrical lines or conductors. The bimetallic thermo-release having a bimetallic compensation element for temperature compensation and a release or trigger element which can be activated as a function of the bending or deflection of the bimetallic release element and the bimetallic compensation element. A heat-conducting connection is provided between the bimetallic compensation element and at least one connection at which there is connected one of the electrical lines.

4 Claims, 1 Drawing Figure

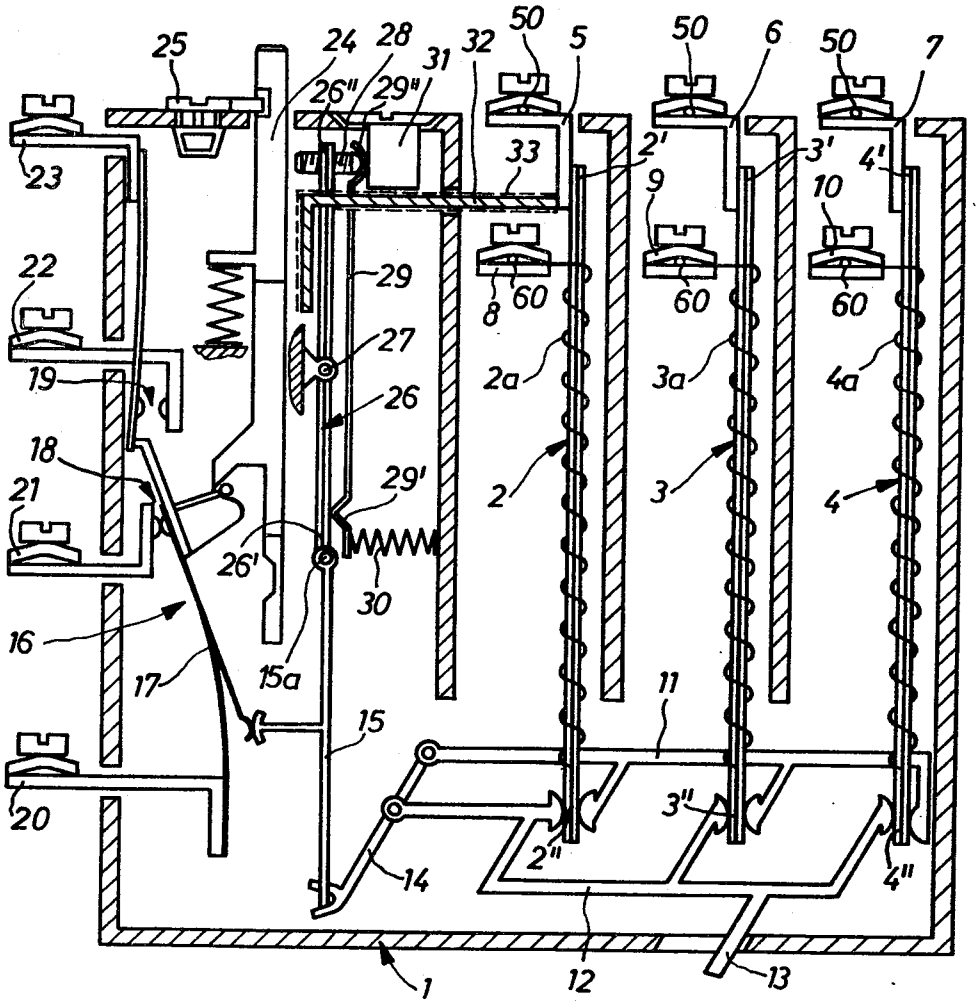
7
6
5
50
50
50
4'
3'
2'
4a
3a
2a
4
3
2
60
60
60
10
9
8
33
32
31
28
29''
26''
24
25
29
27
26
29'
30
26'
15a
15
17
16
18
19
21
22
23
20
14
12
11
13
1
4''
3''
2''

BIMETALLIC THERMO-RELEASE, ESPECIALLY FOR PROTECTIVE MOTOR SWITCH

BACKGROUND OF THE INVENTION

The present invention relates to a new and improved construction of a bimetallic thermo-release, especially for protective motor switches, which is of the type having at least one bimetallic release element operatively connected with connection means or connections for connecting electrical lines or conductors, a bimetallic compensation element for temperature compensation and a release or trigger element which can be activated as a function of the bending or deflection of the bimetallic release element and the bimetallic compensation element.

In a thermo-release or thermo-trigger of this type, as the same has been described for instance in Swiss Pat. No. 449,743, the bimetallic compensation element serves to eliminate the adverse effects of the ambient temperature upon the release or trigger point. With such heretofore known thermo-release devices it has been found to be disadvantageous that there is only compensated the effect of the ambient temperature upon the release or trigger point and there are not in any way taken into account heat sources which likewise effect the release point.

SUMMARY OF THE INVENTION

Hence, with the foregoing in mind, it is a primary object of the present invention to provide an improved construction of bimetallic thermo-release, especially for a protective motor switch, which is not associated with the aforementioned drawbacks and limitations of the prior art proposals.

Still a further significant object of the present invention aims at the provision of a new and improved construction of a bimetallic thermo-release arrangement which is relatively simple in design, economical to manufacture, extremely reliable in operation, not readily subject to breakdown or malfunction, and requires a minimum of maintenance and servicing.

Still a further important object of the present invention is to provide a bimetallic thermo-release wherein there is compensated the heating of the connections upon the release or tripping characteristic of the thermo-release, and at which connections there are coupled the bimetallic release element and the connection lines.

Now in order to implement these and still further objects of the invention, which will become more readily apparent as the description proceeds, the invention contemplates providing a heat-conducting connection between the bimetallic compensation element and at least one of the connections at which there are connected the electrical lines.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically shows a bimetallic thermorelease constructed according to the teachings of the present invention.

DETAILED DESCRIPTION OF THE PREFERRED EMBODIMENTS

Describing now the drawing, there is shown by way of example in the single FIGURE a bimetallic thermo-release or thermo-release arrangement as contemplated by the invention. There will be seen a housing 1 formed of any suitable electrically insulating material. Within the housing 1 there are arranged bimetallic release or trigger elements 2, 3 and 4 through which flow the current of the electrical equipment to be monitored, here assumed to be a motor. The one respective end 2', 3' and 4' of each of these bimetallic release elements 2, 3 and 4 is attached with a respective stationary connection or connection means 5, 6 and 7 with which there are connected the connection lines or conductors, merely schematically generally indicated by reference character 50, and leading to the not particularly illustrated motor. A respective heating coil or winding **2*a*, 3*a* and 4*a* of each bimetallic release element 2, 3 and 4 is connected with a respective second connection 8, 9 and 10, at which there are likewise connected a respective connection line, generally indicated schematically by reference character 60**, and also leading to the motor.

The respective free ends 2'', 3'' and 4'' of the bimetallic release elements 2, 3 and 4 act both upon a phase failure slide 11 and a release or trigger slide 12. This release slide 12 is equipped with an operating knob or key 13 or equivalent structure for accomplishing manual release or triggering. A differential lever 14 is operatively connected with the phase failure slide 11 and the release slide 12. This differential lever 14 acts upon a release or trigger lever 15. The release lever 15 serves to actuate a snap switch 16, which for instance may be of the type as described in Swiss Pat. No. 594,276, to which reference may be readily had and the disclosure of which is incorporated herein by reference. This snap switch 16 will be seen to comprise a resilient element, here shown in the form of a fly spring 17 having a rest contact 18 and a work contact 19. Reference characters 20 and 21 designate the connection terminals of the rest contact 18 and reference characters 22 and 23 designate the connection terminals of the work contact 19.

Now in order to reset the fly spring 17 after it has tripped or triggered, there is advantageously provided a reset element, here shown in the form of a reset plunger 24, with which coacts a rotatable knob 25 for selecting the functional mode. This rotatable knob 25 can be turned with the aid of a suitable tool, such as a screwdriver. The mode of operation of the reset element or plunger 24 and the rotary knob 25 has been described in detail in Swiss Pat. No. 594,284, to which reference may be readily had and the disclosure of which is incorporated herein by reference. Yet, further description thereof, beyond that which has been explained above, is unnecessary for understanding the underlying principles of the present invention, and therefore need not be here further considered.

The release or trigger lever 15 is rotatably mounted at one of its ends, at the pivot means **15*a*, at the free end 26' of a bimetallic compensation element 26, this free end 26' bending or deflecting when exposed to temperature effects. The bimetallic compensation element 26 is rotatably mounted at the pivot point or pivot means 27. The other end 26'' of the bimetallic compensation element 26 is provided with a calibration screw 28 or equivalent structure, screw 28** being supported at a spring 29. This spring 29 bears at its end 29', remote from the end 29" cooperating with the calibration screw 28, against the bimetallic compensation element 26 due to the spring force exerted by a pressure spring 30. The calibration screw 28 and the therewith cooperating end 29" of the spring 29 bear against a rotatable current adjustment element 31 which can be also turned by a suitable tool, such as a screwdriver. By means of the calibration screw 28 it is possible to calibrate the threshold or boundary current, whereas by means of the current adjustment element 31 there can be set the rated current of the motor.

The bimetallic compensation element 26 serves in known manner for compensating the effect of the ambient temperature upon the trigger or release characteristic of the thermorelease. Additionally, the bimetallic compensation element 26 also is used in order to eliminate the effect of the thermal energy which prevails at the connections 5, 6, 7, 8, 9 and 10. For this purpose there is provided a heat-conductive connection, which has been schematically shown in the exemplary embodiment as a heat-conducting element 32, for instance formed of a suitable metal, for example copper, silver or platinum. This heat-conducting element 32 is provided as a heat-conducting connection between at least one of the aforementioned connections, here shown to be the connection 5, and the bimetallic compensation element 26. This heat-conducting element 32 extends from the connection 5 up to the direct neighborhood of the bimetallic compensation element 26 and can be surrounded by a suitable thermal insulation 33, shown only schematically in phantom lines in the drawing. This thermal insulation 33 prevents heat transfer to the connection path between the connection or connection means 5 and the bimetallic compensation element 26.

It has been found that different degrees of heating of the connections 5, 6, 7, 8, 9 and 10 can arise due to different properties of the thermo-release which cannot be controlled by the manufacturer, with the result that there can be differently influenced the release characteristic of the thermo-release. In particular, the selection of the connection lines coupled with the connections 5, 6, 7, 8, 9 and 10 has a considerable effect upon the heating of such connections. On the one hand, the degree of heating of the connections is dependent upon the cross-section of the lines or conductors. With the same line cross-section of the connection lines the heating is smaller than in the case of a line insulation having a larger diameter, since there is available a larger heat transfer surface. Additionally, with the same line cross-section a stranded conductor produces a smaller heating effect than a wire. This heating of the connections, which is dependent upon the selection of the connection line, has a considerable influence upon the release or trigger characteristic. Now this influence is beneficially eliminated by means of the heat-conducting connection 32.

With the illustrated exemplary embodiment there has been shown only one heat-conducting connection or connection means 32 between a single connection 5 and the bimetallic compensation element 26. However, it is also possible to provide such type heat-conducting connections between a number of connections and the bimetallic compensation element 26.

The mode of operation of the thermo-release or thermo-trigger is basically known. The bimetallic release or work elements 2, 3, 4, through which flows the motor current, bend owing to the thermal effects and displace the phase failure and release slides 11 and 12. Consequently, the differential lever 14 is moved which, in turn, actuates the release lever 15. This release lever 15 presses against the fly spring 17 and releases such, thereby opening the rest contact 18 and closing the work contact 19. Resetting of the fly spring 17 is accomplished by means of the resetting plunger or element 24.

Now if during operation of the equipment there occurs failure of one of the phases, then the bimetallic release element which is operatively associated with such phase cools and moves back into its rest position. As a result the phase failure slide 11 is prevented from carrying out any displacement and no longer moves together with the release slide 12. This in turn causes, by means of the differential lever 14, a more rapid release of the snap switch 16.

Under the effect of the ambient temperature and the temperature of the connection 5 the free end 26' of the bimetallic compensation element 26, and at which there is attached the release lever 15, bends or deflects, shifting the pivot or rotation point 15*a* of the release lever 15. Consequently, the influence of the ambient temperature and the heating of the connection 5 upon the release characteristic of the thermo-release arrangement is eliminated. As already mentioned, the bimetallic compensation element additionally serves as a lever for the current setting which is to be undertaken by the current adjusting or setting element 31 and for the threshold current calibration which is to be accomplished by means of the calibration screw or element 28.

The described thermo-release can also be employed for other purposes and as a protective motor switch. Additionally, it is also possible to use fewer than three bimetallic release elements.

While there are shown and described present preferred embodiments of the invention, it is to be distinctly understood that that the invention is not limited thereto, but may be otherwise variously embodied and practiced within the scope of the following claims. Accordingly,

What is claimed is:

1. A bimetallic thermo-release, especially for a protective motor switch, comprising:
   - at least one bimetallic release element;
   - connection means for the connection of electrical lines connected with said bimetallic release element;
   - a bimetallic compensation element for temperature compensation;
   - release means which can be actuated as a function of bending of the bimetallic release element and the bimetallic compensation element;
   - a heat-conducting connection means provided between said bimetallic compensation element and at least one of said connection means for the connection of at least one of the electrical lines.

2. The bimetallic thermo-release as defined in claim 1, wherein:
   - said heat-conducting connection means comprises an element formed of heat-conductive material; and
   - said heat-conductive element extending from said at least one connection means to said bimetallic compensation element.

3. The bimetallic thermo-release as defined in claim 2, wherein:
   - said heat-conductive element is formed of metal.

4. The bimetallic thermo-release as defined in claim 2, further including:
   - thermal insulating means surrounding said heat-conductive element extending between said at least one connection means and said bimetallic compensation element.

* * * * *